United States Patent [19]

Coburn

[11] 4,195,539

[45] Apr. 1, 1980

[54] WEB DIVERTER

[75] Inventor: Robert E. Coburn, Warminster, Pa.

[73] Assignee: Molins Machine Company, Inc., Cherry Hill, N.J.

[21] Appl. No.: 916,315

[22] Filed: Jun. 16, 1978

[51] Int. Cl.[2] ..... B26D 3/08; B65H 29/58

[52] U.S. Cl. ..... 83/44; 83/23; 83/106; 83/408; 93/1 G; 271/287

[58] Field of Search ..... 93/1 G, 58.1, 58.2; 83/23, 105, 106, 44, 408; 271/64

[56] References Cited

U.S. PATENT DOCUMENTS

| | | | |
|---|---|---|---|
| 3,307,441 | 3/1967 | Saunders et al. | 83/106 X |
| 3,408,886 | 11/1968 | David | 83/106 X |
| 3,831,502 | 8/1974 | Tokuno | 93/1 G |
| 3,831,929 | 8/1974 | Hellmer | 83/106 |
| 3,882,765 | 5/1975 | Tokuno | 83/106 |
| 3,951,021 | 4/1976 | Easter | 83/106 |
| 4,041,819 | 8/1977 | Chu et al. | 83/408 |
| 4,100,829 | 7/1978 | Stangl et al. | 83/106 |

*Primary Examiner*—Robert L. Spruill
*Assistant Examiner*—W. D. Bray
*Attorney, Agent, or Firm*—Seidel, Gonda, Goldhammer & Panitch

[57] ABSTRACT

Upper and lower web guides are pivotably mounted for directing the leading edge of a web to either of upper or lower paths. Each web guide has a plurality of resilient members disposed side by side and extending downstream to define a channel through which the web can pass.

10 Claims, 8 Drawing Figures

FIG. 1
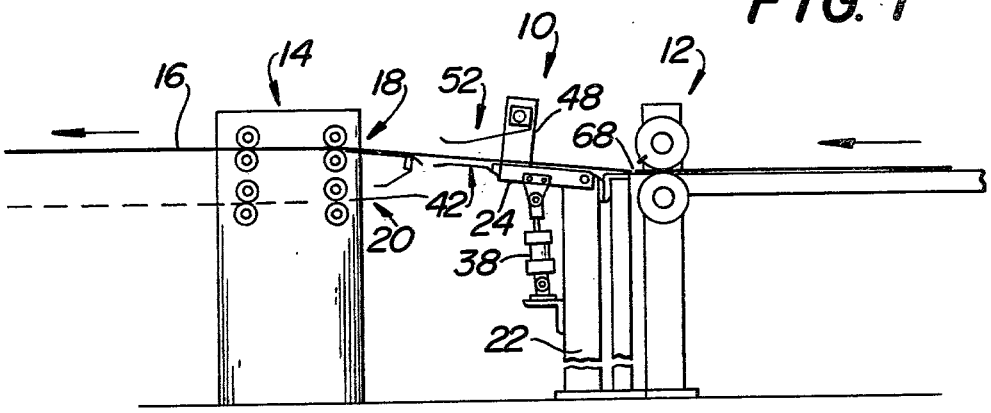
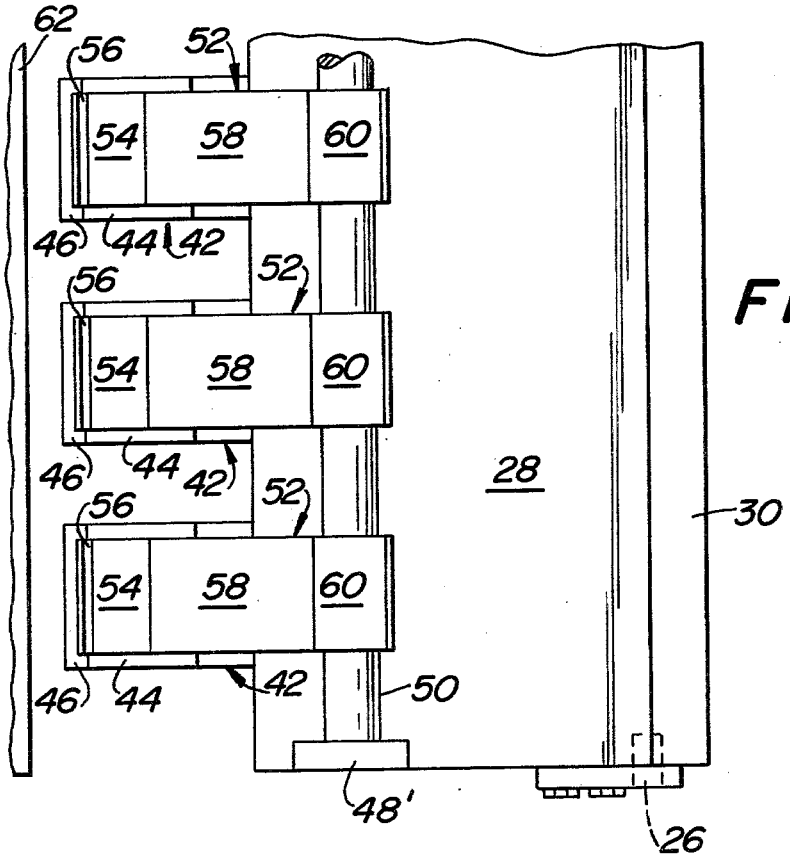
FIG. 3

WEB DIVERTER

BACKGROUND

An objective of the corrugated paperboard industry almost since its inception has been the uninterrupted manufacture of corrugated board. The conventional corrugator includes a number of discrete machines which cooperate to produce sheets of corrugated board which is further processed into boxes. Because boxes are manufactured in a multiplicity of sizes, the machines must be often adjusted to suit the various widths and lengths of sheets.

In order to readjust a particular machine, it has been the custom to stop or reduce the speed of those machines upstream from the machine which is to be readjusted. This causes both lost production and deterioration of the board, particularly if it is in the hot double facer machine.

One of the key machines in this process has been the slitter-scorer which slits the wide web into suitable widths and creases the board to facilitate folding. To change the setting of this machine, the conventional procedure has been to reduce the speed of the corrugator, shear the web upstream of the slitter-scorer and then to reduce further the speed of the upstream web to produce a gap. The slitter-scorer was readjusted during the interval in which this machine was in the gap.

It is desirable to provide a corrugator capable of changing instantaneously from processing sheets of one specification to processing sheets of another specification. The key to solution of this problem lay in satisfactorily diverting the leading edge of the sheared web into an alternate preset slitter-scorer station without materially separating this leading edge from the trailing edge of the outgoing web.

Previous attempts to solve this problem are shown in U.S. Pat. Nos. 3,831,502 and 3,882,765 which disclose exceedingly complex apparatus requiring the repositioning of massive structures and guide tables. Further, the diverters described in these patents and U.S. Pat. No. 3,831,929 require a large number of solenoids, limit switches and the like. An earlier attempt is shown in U.S. Pat. No. 3,408,886. Each of the machines described in said patents has received only limited acceptance by the industry.

In contrast to the prior known web diverters, the web diverter of the present invention materially simplifies the number of elements while providing a machine which is positive-acting, simple, inexpensive and reliable.

SUMMARY OF THE INVENTION

The web diverter of the present invention includes apparatus for selectively diverting a web to each of upper or lower paths. A web support member is provided with an upstream portion and a downstream portion. A means is provided for mounting the support member for movement between first and second positions.

The apparatus of the present invention includes means for contacting the trailing edge of a web section severed from a web and for diverting the leading edge of the cut web so that it follows a path different from the path of the severed web section. Such means includes upper and lower web guides mounted on said support member adjacent the downstream portion thereof. Each of the web guides preferably includes a plurality of resilient members disposed side by side and extending downstream from said support member. Said resilient members form a channel through which the web passes.

The apparatus of the present invention includes a power means connected to said support member for selectively moving said support member between a first position wherein said lower web guide members prevent a web from being diverted to the lower path and a second position wherein said upper web guide members prevent the web from being directed to said upper path.

It is an object of the present invention to provide a web diverter which is simple, inexpensive and reliable for selectively diverting a web to each of upper and lower paths.

A further object of the present invention is to provide a web diverter which can divert a moving web selectively to either of two paths without requiring formation of a gap between the trailing end of the outgoing web and the leading end of the incoming web.

An additional object of the present invention is to provide a web diverter which can instantaneously change the path of a sheared web from one flight path to another flight path.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a side elevation view of apparatus in accordance with the present invention.

FIG. 3 is a plan view taken along the line 3—3 in FIG. 2 with the web being eliminated for purposes of illustration.

Figure 2:
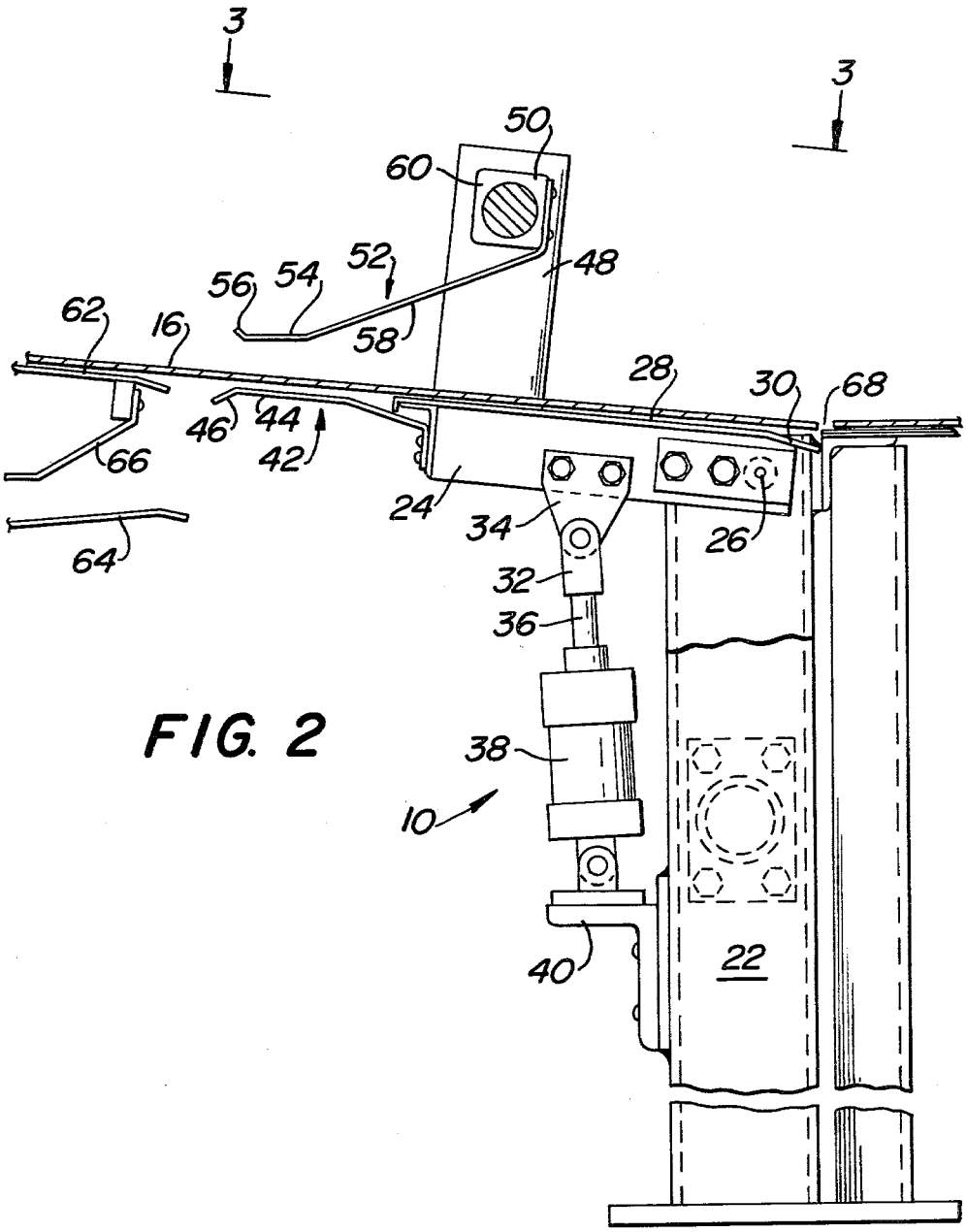
FIG. 2 is an enlarged view of the apparatus shown in FIG. 1.

Referring to the drawings in detail, wherein like numerals indicate like elements, there is shown in FIG. 1 a web diverter in accordance with the present invention designated generally as 10 and disposed between an order change shear 12 and a slitter-scorer 14. A web 16 is adapted to be diverted to either one of the upper path 18 or lower path 20 in the slitter-scorer 14. The web 16 is preferably a web of corrugated paperboard.

Referring to FIGS, 2 and 3, the diverter 10 includes a frame 22 extending transversely across the path of the web 16. A web support member 24 is mounted on the frame 22 for pivotal movement about the pin 26. The web support member 24 has a support surface 28 for supporting the web and a bevel 30 at its upstream portion located adjacent to the pivot pin 26. Support surface 28 may be of sheet metal and extends transversely across the full width of the diverter 10.

In FIG. 2, the web 16 is being diverted to the upper path 18. A power means is provided for pivoting the web support member 24 about pin 26 so that the web may be diverted to the lower path 20. The power means includes a clevis 32 pivotally connected at one end to a bracket 34 on the lower side of the web support member 24. The other end of clevis 32 is connected to one end of piston rod 36. The other end of piston rod 36 is connected to a piston disposed within the cylinder 38. The cylinder 38 at its lower end is pivotally connected to a bracket 40 on frame 22. Conduits for selectively introducing a motive fluid such as pressurized air into opposite ends of the cylinder 38 are not shown.

The web support member 24 is provided with a plurality of lower web guide members 42 which are disposed side by side and extend in a downstream direction from the downstream portion of web support member 24. See FIGS. 2 and 3. The guide members 42 are preferably made from a flexible resilient material such as spring steel, reinforced plastics, etc. One end of the members 42 is removably fastened to the downstream portion of web support member 24 in any convenient manner such as by screws.

The lower web guide members have a flat portion 44 which constitutes a major portion of the length and an upwardly angled portion 45. Each web guide member 42 terminates in a downwardly angled portion 46. A pair of upright posts 48, 48' are connected to the web support member 24 and extend upwardly therefrom. A shaft 50 extends between and is supported by the posts 48, 48'. The shaft 50 supports a plurality of upper web guide members 52 which are disposed side by side and extend in a downstream direction from the downstream end portion of the web support member 24.

The upper web guide members 52 include a flat portion 54 disposed between angled portions 56, 58. Angled portion 56 is at the terminal end of members 52. Angled portion 58 extends upwardly to a head 60 which is slideably adjustable on shaft 50. The respective angled portions 46 and 56 diverge in a downstream direction from the flat portions 44, 54 while portions 45, 58 diverge from said flat portions in an upstream direction. Members 52 are attached to their respective heads in any convenient manner such as by threaded fasteners. A set screw or other convenient means may be utilized to secure the heads 60 to the shaft 50 in any predetermined disposition. The preferred disposition is to have each member 52 disposed above one of the members 42 as shown more clearly in FIGS. 3 and 4. While not essential, the members 53 are preferably slightly narrower than the members 42. The flat portions 44, 54 on the members 42, 52 respectively define a channel through which the web 16 can pass. Such channel is preferably 1 to 2 inches high. When the web 16 is directed to the upper path 18, it is supported by a lead plate 62 on the slitter-scorer 18. The slitter-scorer 18 has a lead plate 64 and a deflector plate 66 for directing a web to path 20.

Let it be assumed that the web 16 is being fed to the path 18 as shown in FIGS. 1 and 2. The slitting and scoring elements associated with path 20 will have been preadjusted to the desired positions for producing the next production order. At the end of the production order for path 18 and in response to an appropriate signal, the shear 12 severs the web 16. A gap 68 is formed between the leading edge 70 and trailing edge 72. The speed of said edges is maintained substantially constant since it is not necessary to materially increase the size of gap 68.

Figure 4:
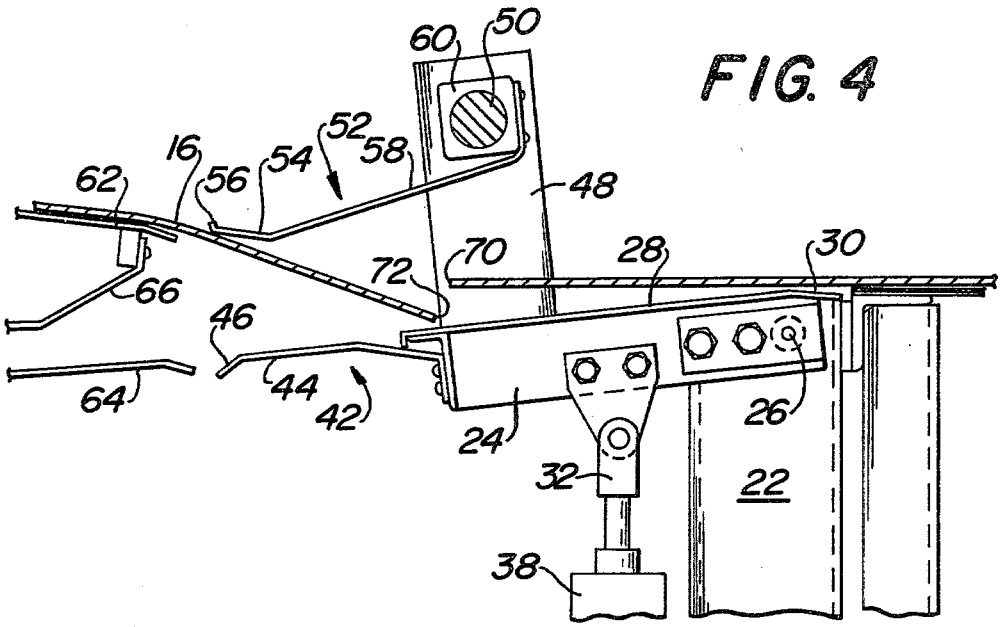
FIGS. 4 and 5 are views similar to FIG. 2 but showing the position of the components when the leading edge of a web is being diverted to the lower path.
Figure 5:
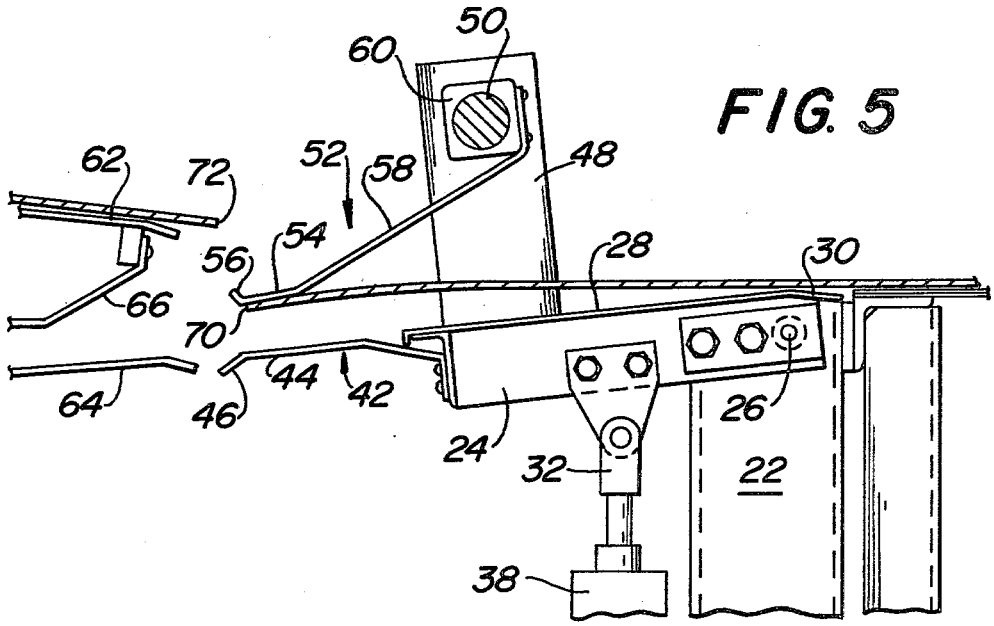
Figure 6:
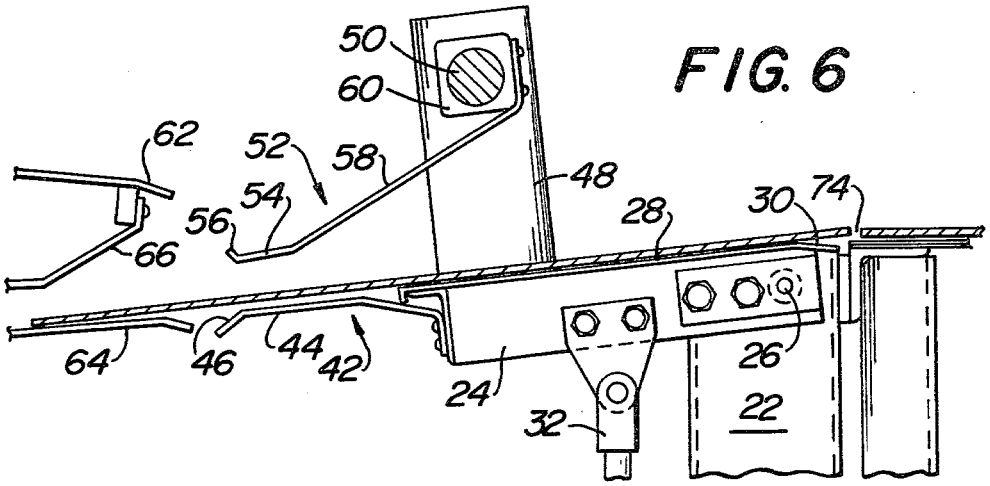
FIG. 6 is a view similar to FIG. 2 but showing the web already diverted to the lower path.

Simultaneously with the severing of a web 16, motive fluid will be introduced into cylinder 38 to pivot the diverter 10 through an arc of 8°-15° from the position shown in FIG. 2 to the position shown in FIG. 4. Such movement causes the lower web guide members 42 to be generally aligned with the lead plate 64 and also causes the upper web guide members 52 to be in flexed contact with and apply pressure in a downward direction against the top surface of the trailing end portion of the web 16. As soon as the trailing edge 72 clears the upper web guide members 52, said members flex downwardly to the position shown in FIG. 5. When the leading edge 70 arrives, it is deflected downwardly by contact with portions 58 and 54 respectively of the upper web guide members 52. See FIG. 5. Thereafter, the web is directed to the lower path 20. The components of the diverter 10 assume the position shown in FIG. 6 while the web is being directed to the lower path 20.

Figure 7:
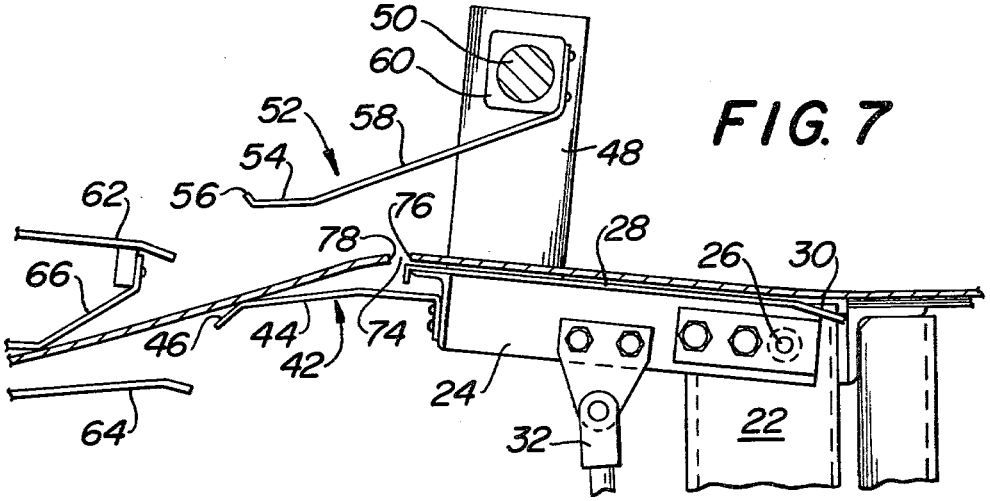
FIGS. 7 and 8 are views similar to FIG. 2 but showing the position of the components when the leading edge of a web is being diverted to the upper path.
Figure 8:
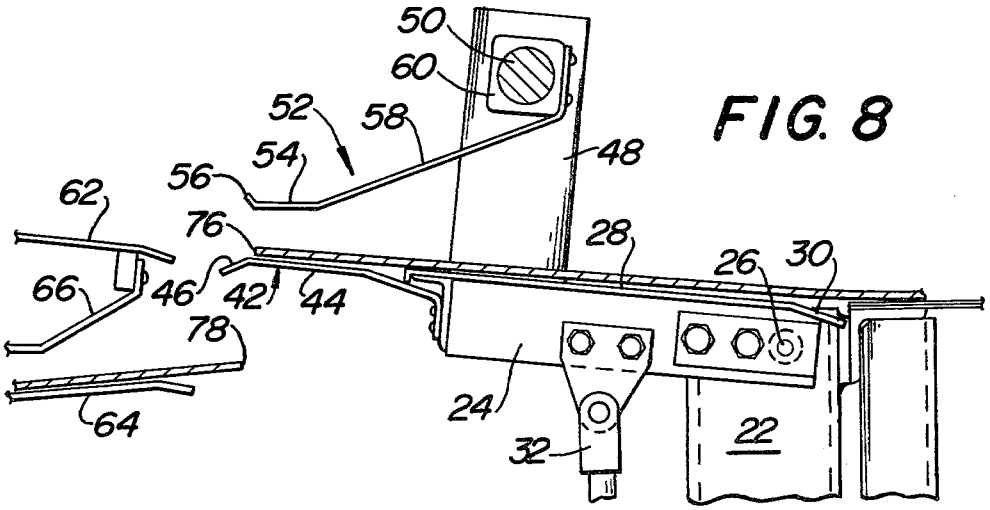

At the completion of the last described production order, the web is again severed by the shear 12 to produce the gap 74 defined by the leading edge 76 and the trailing edge 78. While the web was diverted to path 20, the slitting and scoring elements associated with path 18 were prepositioned for the next production order. Simultaneously with the severing of the web to produce gap 74, motive fluid was introduced into the lower end of cylinder 38 to move the diverter 10 from the position shown in FIG. 6 to the position shown in FIG. 7. With the components in the position shown in FIG. 7, the lower web guide members 42 are in flexed contact with the trailing end portion of the web. As soon as the trailing end 78 clears the lower web guide members 42, such members flex upwardly to the position shown in FIG. 8 so as to support the leading edge 76 and direct the same to path 18. It will be noted that the illustration in FIG. 8 corresponds to the illustration in FIG. 2. Hence, the web continues to be processed as described above until the next change order occurs.

The actuation of the web support member 24 is preferably simultaneous with the severing of the web by the shear 12. In this manner, a single signal may be utilized to initiate two different actions thereby eliminating the need for precise timing or tracking controls necessary by the prior art to divert elements while they are disposed in the gap between the leading and trailing edges of the webs. The diverter of the present invention eliminates the need for a gap having a substantial length. Further, there is only a single power means which simultaneously diverts all of the upper and lower web guide members. When the web support member is moved from either of its operative dispositions, one of the sets of upper and lower guide members will be flexed and in contact with a surface of the trailing edge portion of the web and will independently move to a web guiding position upon clearance of the trailing edge of the severed web section.

Thus, it will be seen that the diverter of the present invention is simple, economical, has minimum elements and controls while at the same time being efficient. Minimum maintenance is required and the diverter in inexpensive. Another advantage is that diverter 10 occupies minimum floor space. With support 24 having a length of about 12 inches and members 42 having a length of about 6 inches, diverter 10 occupies only about 18 inches in the direction of feed. A wide choice of resilient materials are available for use in manufacturing the guide members 42, 52.

The number of guide members 42, 52 may be varied as desired. The preferred width for such members 42, 52 is approximately 4 to 6 inches. The members 42, 52 are preferably provided in sufficient number so that a mating set of such members lies along the side edge portions of the web and extend slightly beyond the side edges of the web to prevent the side edge portions of the web from drooping.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus between a shear and a slitter scorer for selectively diverting the web which has been sheared transversely to upper and lower paths in the slitter scorer comprising:

(a) a web support member having an upstream portion and a downstream portion, means mounting said support member for movement from a first position wherein a web is being directed to an upper path and a second position wherein a web is being directed to a lower path, (b) means for contacting one surface of the trailing end portion of a severed web including upper and lower web guides mounted on said support member adjacent the downstream portion thereof, said web guides extending downstream from said support member and forming therebetween a channel through which a web can pass, said web guides being resilient so that when a web is sheared transversely the upper or lower guides are in flexed contact with the trailing edge portion of the web traveling along one of said paths and then flex to guide the leading edge portion of the web to the other path, (c) power means connected to said support member for selectively moving said support member between the first position wherein said lower web guide prevents a web from being directed to the lower path and the second position wherein said upper web guide prevents a web from being directed to said upper path.

2. Apparatus in accordance with claim 1 wherein said support member is pivotally supported adjacent its upstream portion, said power means being connected to said support member for selectively pivoting said support member between said first and second positions.

3. Apparatus in accordance with claim 1 or 2 wherein each of said web guides includes a plurality of resilient members disposed side-by-side, and each of said resilient members being supported as a cantilever with two portions thereof disposed in different planes.

4. Apparatus in accordance with claim 1 wherein said upper and lower web guides include mating sets of resilient members which at least in part converge in a downstream direction.

5. Apparatus for selectively diverting a web to upper and lower paths comprising a frame, a web support member mounted on said frame and having an upstream portion and a downstream portion, means mounting the support member on said frame for pivotable movement about a horizontal axis at the upstream portion of said support member, upper and lower web guides mounted on said support member adjacent the downstream portion thereof, each of said web guides including a plurality of resilient members disposed side by side and spaced from one another, each of said web guides extending downstream from said support member, said upper and lower web guides forming a channel through which a web can pass, and power means connected to said support member for pivoting said support member a first position wherein said lower web guide members have flexed contact with a web moving along the lower path and then prevent the leading edge of a sheared web from being directed to said lower path and a second position wherein said upper web guide members have flexed contact with a web moving along the upper path and then prevent the leading edge of a sheared web from being directed to said upper path.

6. Apparatus disposed between a shear and a slitter scorer for selectively diverting a continuously moving, transversely sheared web or corrugated paperboard to upper and lower paths through the slitter scorer comprising:

(a) a web support member having an upstream portion and a downstream portion, means mounting said support member for movement from a first position wherein a web is being directed to the upper path and a second position wherein a web is being directed to the lower path;

(b) power means connected to said support member for selectively moving said support member between the first position and the second position; and (c) means for diverting the moving web by contacting one surface thereof including upper and lower web guides mounted on said support member adjacent the downstream portion thereof, said web guides extending downstream from said support member and forming therebetween a channel through which a web can pass; said web guides being resilient so that when a web is sheared and the position of said web support member is changed, either of said upper or lower eb guides is flexed by contact with the trailing edge portion of the sheared web and, as the trailing end portion leaves the channel between said web guides, the leading edge of the incoming sheared web is diverted by flexure of said flexed web guides.

7. A method for selectively diverting a web to each of upper and lower web paths comprising the steps of:

(a) directing a web through a channel defined by upper and lower resilient web guides mounted on a common support member, (b) supporting said web support member for movement between a first position wherein the web is directed to an upper path and a second position wherein the web is directed to a lower path, (c) feeding the web to one of said paths, severing the web transversely to separate the trailing edge from the leading edge, (d) moving said support member to one of said positions before said leading edge arrives at the web guides and thereby causing one of said web guides to be in flexed contact with the trailing end portion of the web, and flexing said one web guide after it looses contact with the trailing edge so that said one web guide thereafter directs the leading edge to the other path.

8. A method in accordance with claim 7 including using a plurality of separate discrete resilient members disposed side-by-side for each of said web guides, and supporting said resilient members in a manner so that at least in part they converge toward one another in a downstream direction to form a channel through which the web can pass and be directed to one of said paths.

9. A method in accordance with claim 7 or 8 including maintaining the speed of the trailing and leading edges of the web substantially constant after said web is severed so that each of said edges is at said web support member at the same time.

10. A method in accordance with claim 9 including moving said support member between said positions by pivoting the support member about a horizontal axis adjacent the leading edge of said support member.

* * * * *